US007028736B1

(12) United States Patent
Miller

(10) Patent No.: US 7,028,736 B1
(45) Date of Patent: Apr. 18, 2006

(54) TAPE DISPENSING SYSTEM

(76) Inventor: Dewey R. Miller, 810 N. University Dr., Fargo, ND (US) 58102

( * ) Notice: Subject to any disclaimer, the term of this patent is extended or adjusted under 35 U.S.C. 154(b) by 183 days.

(21) Appl. No.: 10/388,294

(22) Filed: Mar. 12, 2003

(51) Int. Cl.
*B32B 31/08* (2006.01)

(52) U.S. Cl. ..... 156/543; 156/544; 156/304.1; 156/324

(58) Field of Classification Search ..... 156/304.1, 156/324, 502, 504, 538, 539, 543, 544, 555, 156/556, 566, 157; 428/343, 355 RA; 242/551, 242/555, 555.1, 555.2, 555.3, 555.4

See application file for complete search history.

(56) References Cited

U.S. PATENT DOCUMENTS

| | | | | |
|---|---|---|---|---|
| 3,193,433 | A | 7/1965 | Tillotson | 156/527 |
| RE30,787 | E | 11/1981 | Pool et al. | 156/527 |
| 4,415,400 | A | 11/1983 | Rammelmeyr | 156/555 |
| 4,582,737 | A | 4/1986 | Torgerson et al. | 428/57 |
| 4,981,537 | A | 1/1991 | Heil et al. | 156/71 |
| 5,624,526 | A * | 4/1997 | Perecman et al. | 156/361 |
| 6,051,095 | A * | 4/2000 | Butterworth | 156/285 |
| 6,596,111 | B1 * | 7/2003 | Cyr et al. | 156/157 |

* cited by examiner

*Primary Examiner*—Jessica Rossi

(57) ABSTRACT

A tape dispensing system for reducing the amount of time to mask surface areas in preparation of painting. The tape dispensing system includes a frame structure having a first frame and a second frame, a first spool and a second spool rotatably attached to the frame structure for supporting a first roll and a second roll of tape, and a first guide member and a second guide member attached to the frame for guiding the tape strips to overlap one another with the respective adhesive sides opposite one another.

9 Claims, 8 Drawing Sheets

TAPE DISPENSING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to tape dispensers and more specifically it relates to a tape dispensing system for reducing the amount of time to mask surface areas in preparation of painting.

2. Description of the Related Art

Tape dispensers have been in use for years. Typically, a tape dispenser is comprised of a structure capable of retaining only a single roll of tape for dispensing a single strip of tape having a single adhesive layer. During masking of walls, trim, windows, doors, vehicles and the like in preparation for painting, the user of a conventional tape dispenser must first secure a first strip of tape to the object to be protected from paint along the edge thereof. The user then must secure a protective sheet (plastic, paper or the like) with a second strip of tape to a portion of the first strip of tape.

The main problem with conventional tape dispensers and masking methods is that they are time consuming and tedious to utilize. A further problem with conventional tape dispensers and masking methods is that they do not provide an efficient and quality means for protecting edging, trim, windows and the like during painting. Another problem with conventional tape dispensers and masking methods is that they do not provide a consistent protective product.

While these devices may be suitable for the particular purpose to which they address, they are not as suitable for reducing the amount of time to mask surface areas in preparation of painting. Conventional tape dispensers and masking methods are time consuming to utilize.

In these respects, the tape dispensing system according to the present invention substantially departs from the conventional concepts and designs of the prior art, and in so doing provides an apparatus primarily developed for the purpose of reducing the amount of time to mask surface areas in preparation of painting.

BRIEF SUMMARY OF THE INVENTION

In view of the foregoing disadvantages inherent in the known types of tape dispensers now present in the prior art, the present invention provides a new tape dispensing system construction wherein the same can be utilized for reducing the amount of time to mask surface areas in preparation of painting.

The general purpose of the present invention, which will be described subsequently in greater detail, is to provide a new tape dispensing system that has many of the advantages of the tape dispensers mentioned heretofore and many novel features that result in a new tape dispensing system which is not anticipated, rendered obvious, suggested, or even implied by any of the prior art tape dispensers, either alone or in any combination thereof.

To attain this, the present invention generally comprises a frame structure having a first frame and a second frame, a first spool and a second spool rotatably attached to the frame structure for supporting a first roll and a second roll of tape, and a first guide member and a second guide member attached to the frame for guiding the tape strips to overlap one another with the respective adhesive sides opposite one another.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a tape dispensing system that will overcome the shortcomings of the prior art devices.

A second object is to provide a tape dispensing system for reducing the amount of time to mask surface areas in preparation of painting.

Another object is to provide a tape dispensing system that assists in providing an efficient and quality paint-masking job.

An additional object is to provide a tape dispensing system that produces a tape product with a first adhesive surface and a second adhesive surface for securing a protective sheet of plastic or paper.

A further object is to provide a tape dispensing system that is comprised of a compact and portable structure.

Another object is to provide a tape dispensing system that provides a manageable end tape product.

A further object is to provide a tape dispensing system that allows for the overlapping of two strips of tape at various overlap widths.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Introduction

Figure 1:
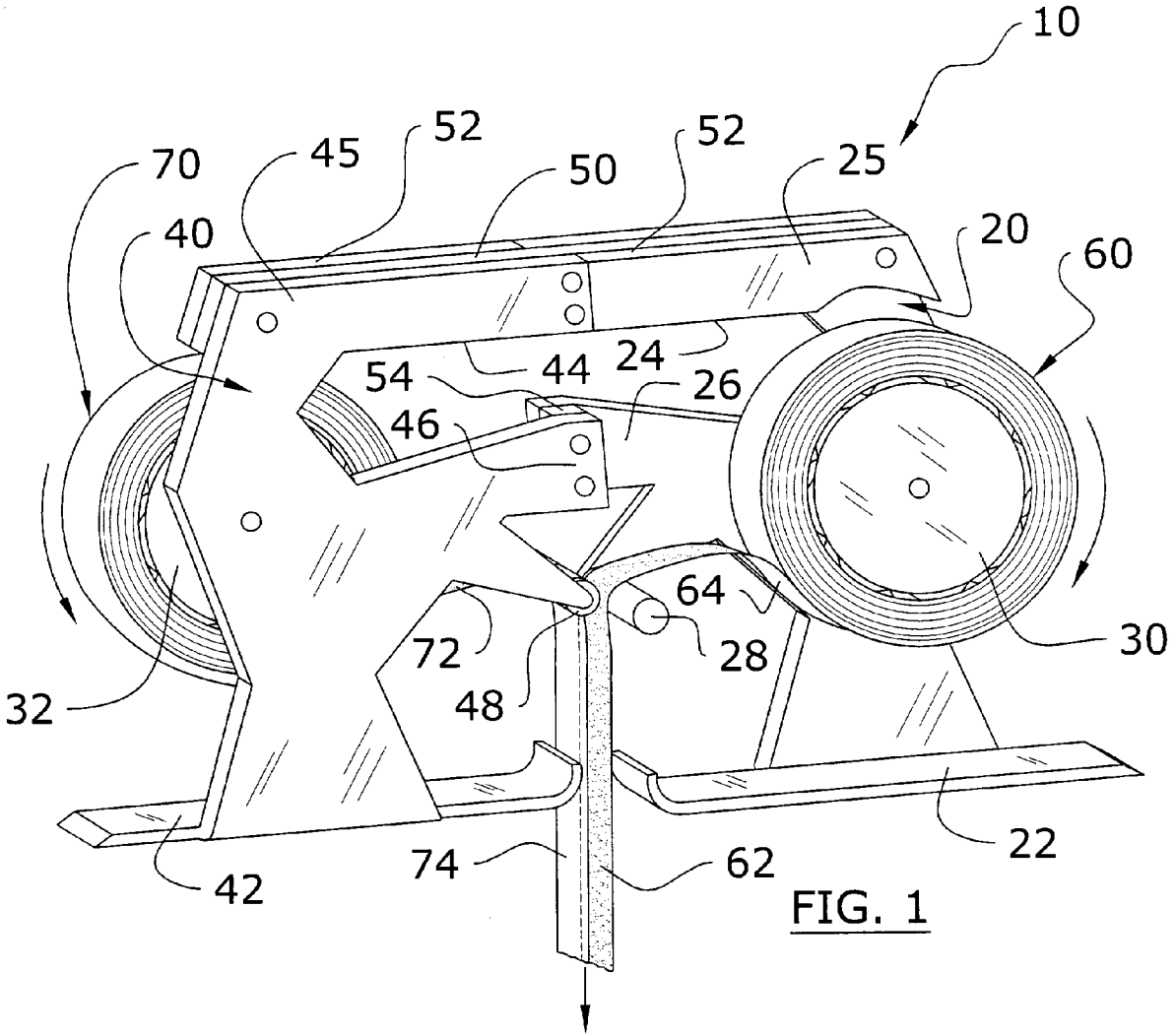
FIG. 1 is an upper perspective view of the present invention.

Turning now descriptively to the drawings, in which similar reference characters denote similar elements throughout the several views, FIGS. 1 through 8 illustrate a tape dispensing system 10, which comprises a frame structure having a first frame 20 and a second frame 40, a first spool 30 and a second spool 32 rotatably attached to the frame structure for supporting a first roll and a second roll of tape, and a first guide member 28 and a second guide member 48 attached to the frame for guiding the tape strips to overlap one another by a width X with the respective adhesive sides opposite one another thereby forming the end tape product.

B. Frame Structure

Figure 2:
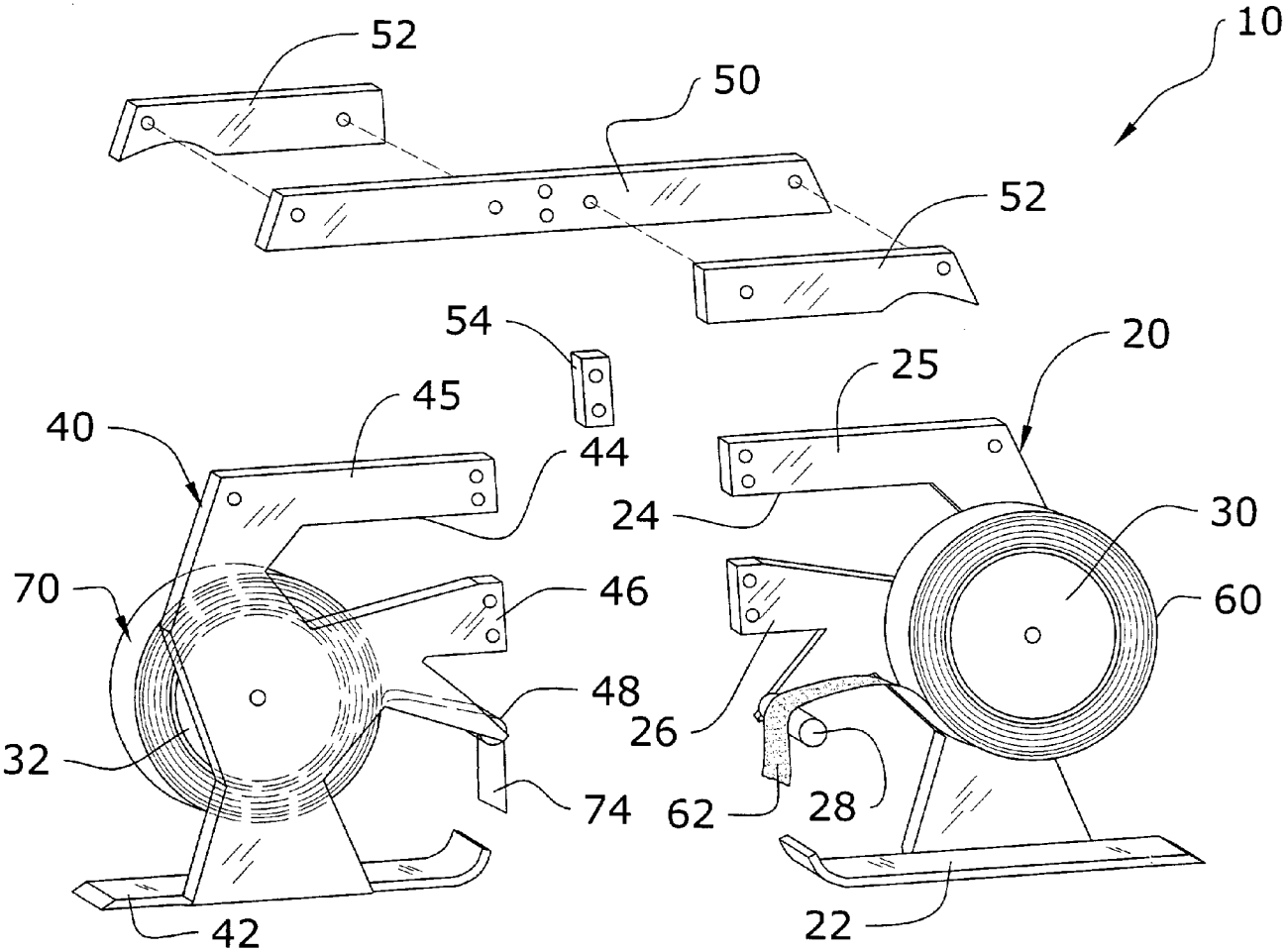
FIG. 2 is an exploded upper perspective view of the present invention.
Figure 3:
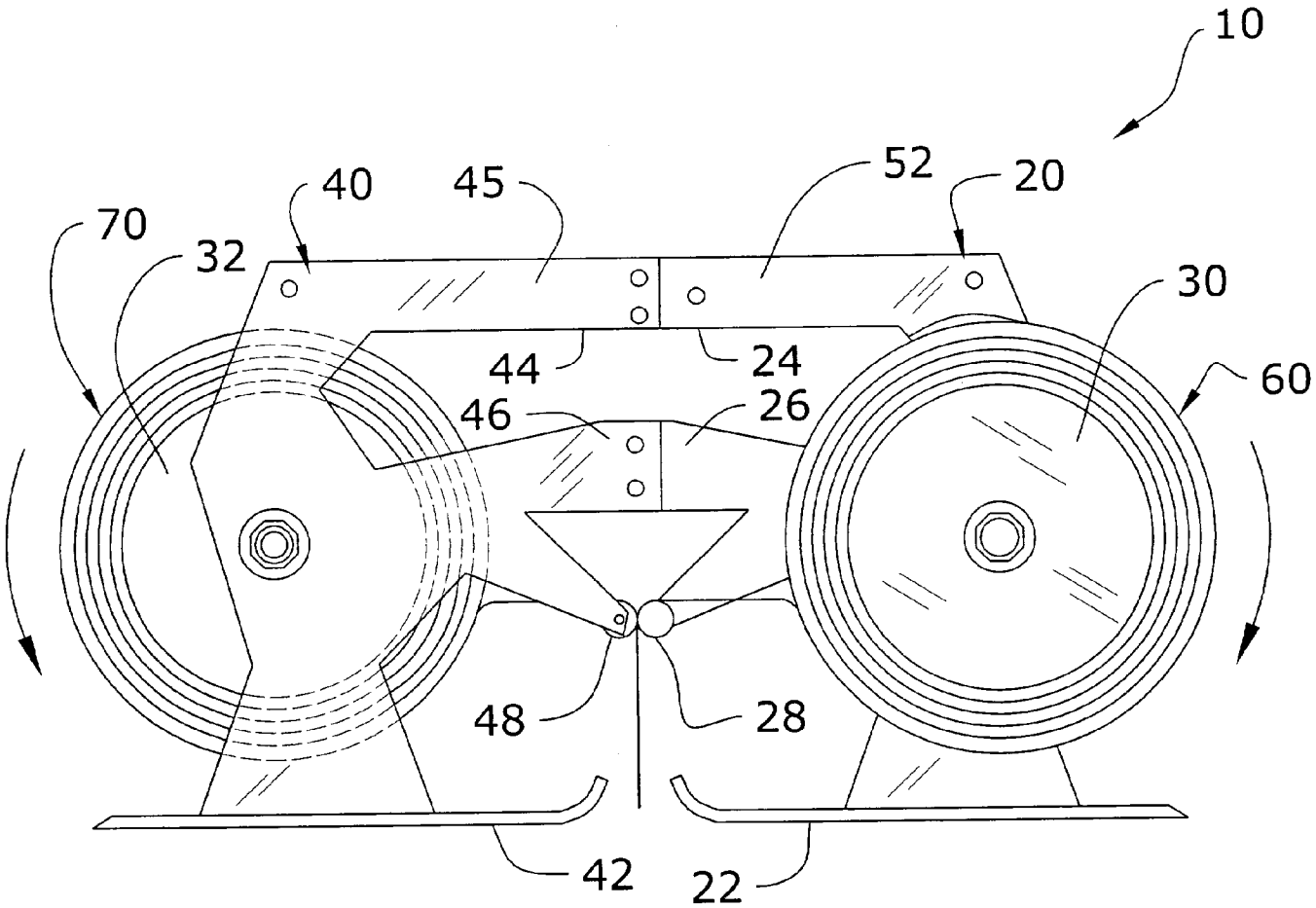
FIG. 3 is a side view of the present invention.

The frame structure is best illustrated in FIGS. 1 and 3 of the drawings. The frame structure is preferably comprised of a first frame 20 and a second frame 40 adjustably connected to one another for allowing adjustment of the width X that the two tape strips overlap one another as best shown in FIG. 2 of the drawings. However, the frame structure may be comprised of various other structures other than shown in the drawings. For example, the frame structure may be comprised of a single unitary structure. The frame structure may have various shapes, sizes and material types.

The frame structure preferably includes a handle for allowing the user to transport the tape dispensing system 10 to remote locations. The handle is formed by a first cutout 24 within the first frame 20 and a second cutout 44 within the second frame 40 as best illustrated in FIG. 2 of the drawings. The cutouts 24, 44 create a first handle 25 and a second handle 45 within the frames 20, 40 respectively as best shown in FIG. 2 of the drawings.

Figure 4:
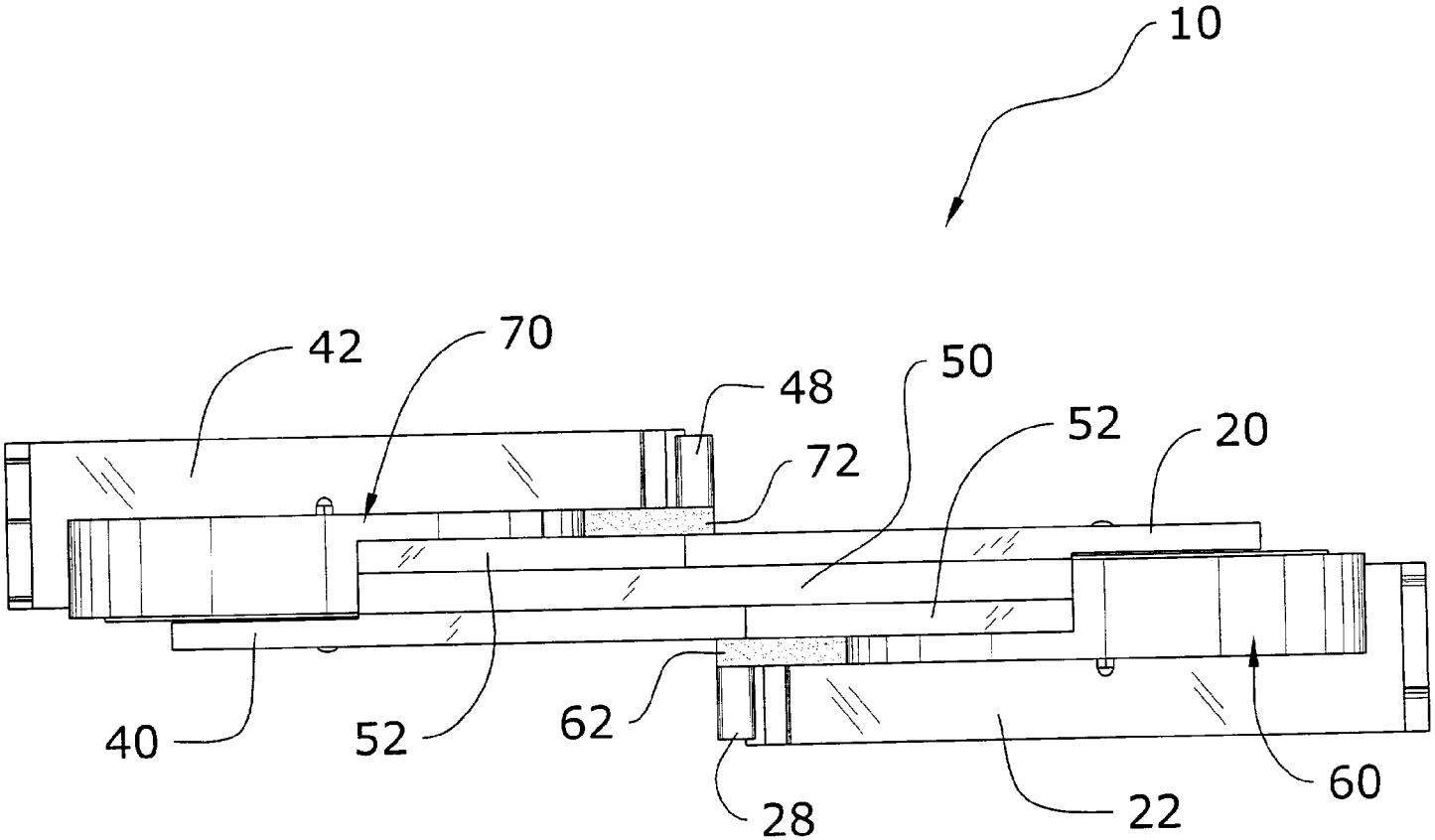
FIG. 4 is a top view of the present invention.

One or more spacer members are preferably attachable between the first frame 20 and the second frame 40 thereby allowing adjustment of the width X of the end tape product. A main spacer 50 preferably extends between both the first frame 20 and the second frame 40 as shown in FIGS. 2 and 4 of the drawings. One or more first spacers 52 may be attached to opposing sides of the main spacer 50 to create a consistent width for the handle of the frame structure. One or more second spacers 54 are positionable between a first extended portion 26 and a second extended portion 46 of the frames 20, 40 respectively. The spacers are preferably attached to the frames 20, 40 by conventional fasteners such as but not limited to bolts, nuts, screws and the like.

The frame structure preferably includes a base structure for supporting the tape dispensing system 10 and for assisting in securing the end tape product. The base structure is preferably comprised of a first base 22 extending from the first frame 20 and a second base 42 extending from the second frame 40. The first base 22 and the second base 42 are preferably positioned apart from one another a finite distance. The first base 22 and the second base 42 are preferably aligned with the first spool 30 and the second spool 32 as best illustrated in FIGS. 2 and 4 of the drawings. The inner ends of the first base 22 and the second base 42 are preferably curved for engaging the first tape strip and the second tape strip to facilitate the connection of the tape strips together.

C. Spools

The first spool 30 and the second spool 32 are rotatably attached to the frame structure for supporting a first tape roll 60 and a second tape roll 70 respectively. The first spool 30 and the second spool 32 are formed from a spool structure that snugly and securely receives the first tape roll 60 and the second tape roll 70 respectively. There are various spool structures currently utilized within conventional tape dispensers that are suitable for usage within the present invention. The first spool 30 and the second spool 32 may have various diameters and widths to accommodate various sizes of tape rolls 60, 70.

As an alternative to utilizing the first frame 20 and the second frame 40 to adjust the width X of the overlap of the end tape product, the first spool 30 and the second spool 32 may be adjustably attached to the frame structure allowing for adjustment of the distance between the rotational planes. The adjustment of the distance between the rotational planes of the first spool 30 and the second spool 32 allows for adjustment of the width X.

Figure 5:
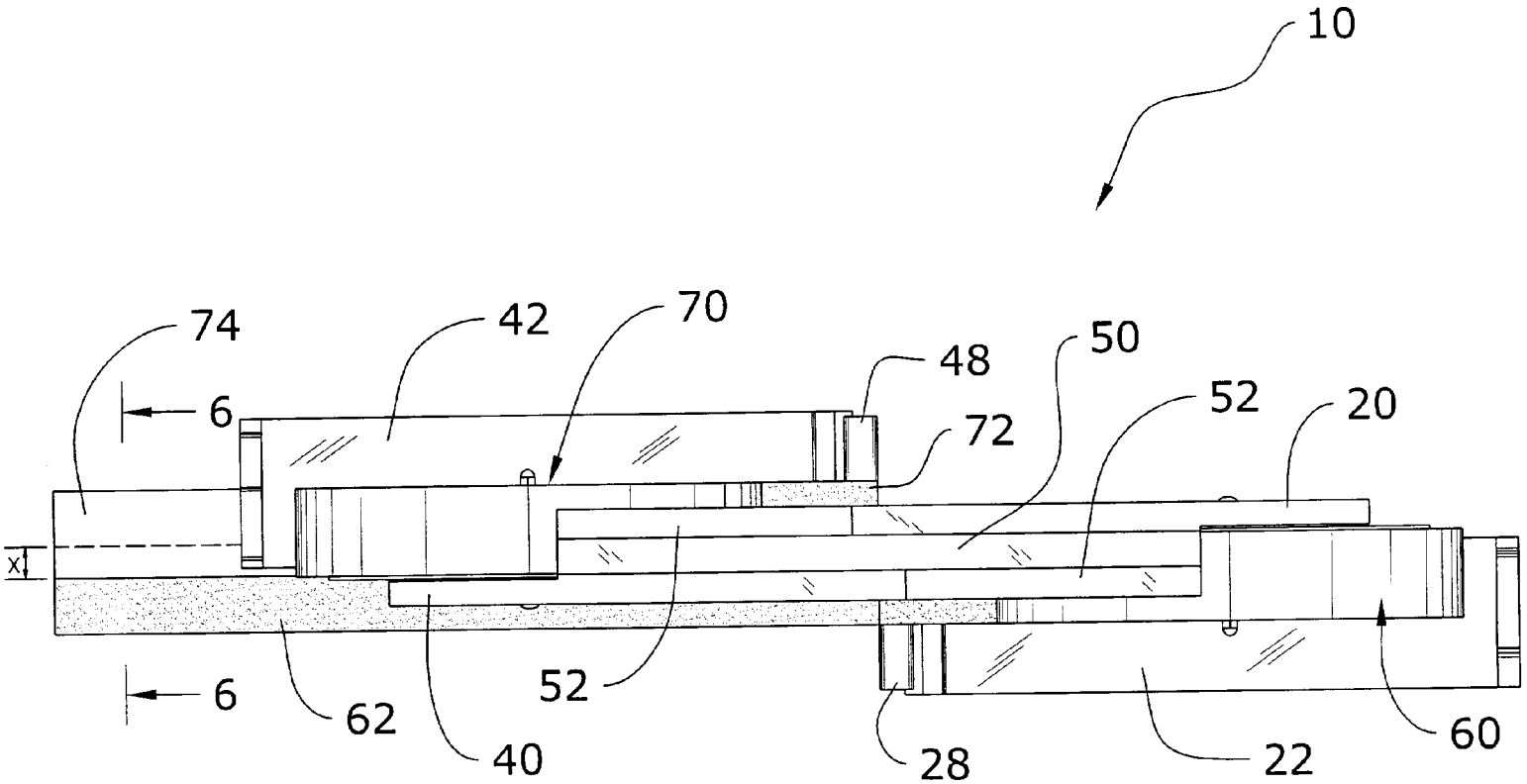
FIG. 5 is a top view of the present invention with the end tape product produced.

As best shown in FIGS. 1, 4 and 5 of the drawings, the first spool 30 and the second spool 32 preferably have substantially parallel rotational planes. The rotational planes of the first spool 30 and the second spool 32 are a distance Y apart, wherein the distance Y is approximately equal to the width X representing the overlapping width of the two tape strips. The width X is preferably less than ½ a width of the first tape strip, though greater widths may be accomplished. As shown in FIGS. 1 and 3 of the drawings, the first tape roll 60 and the second tape roll 70 rotate opposite of one another during operation of the tape dispensing system 10.

D. Guide Members

The first guide member 28 and the second guide member 48 are attached to the frame for guiding first tape strip and the second tape strip respectively to overlap one another a width X during dispensing forming the end tape product. The first guide member 28 and the second guide member 48 may be comprised of a rotatable or a non-rotatable roller structure. Various other curved or angled structures may be utilized to comprised the first guide member 28 and the second guide member 48 to assist in the guiding and securing of the tape strips.

E. End Tape Product

Figure 6:
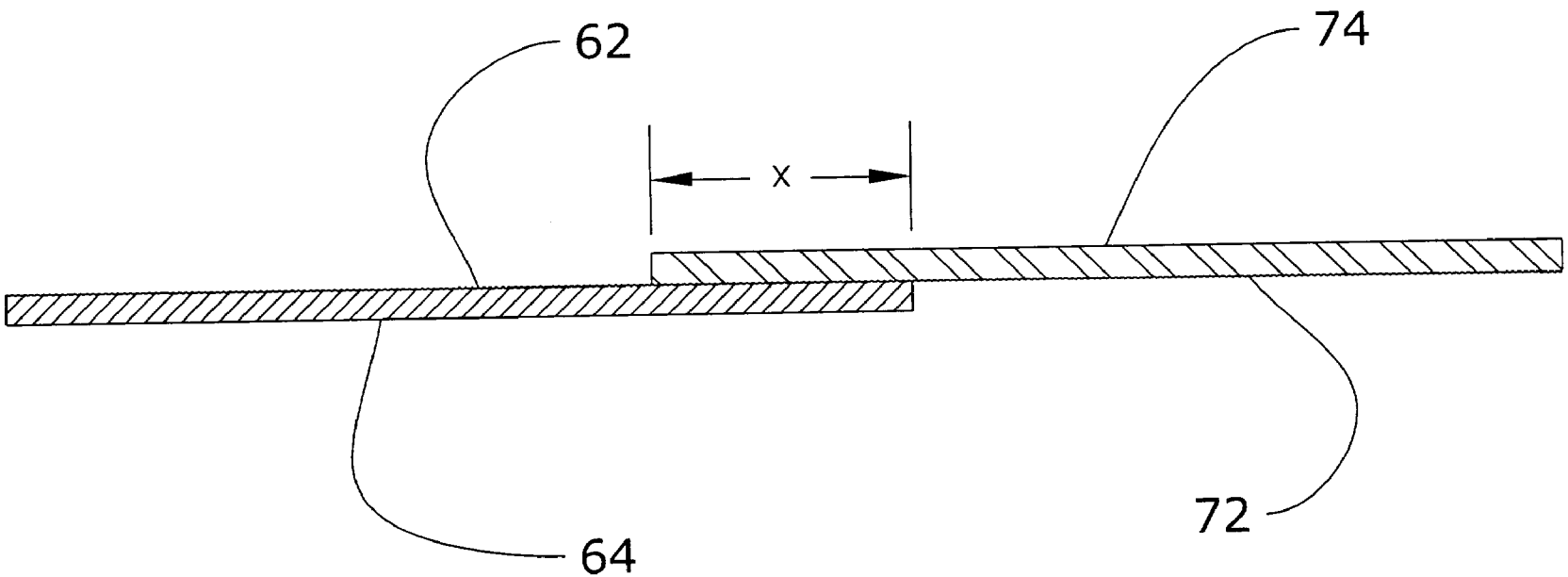
FIG. 6 is a cross sectional view taken along line 6—6 of FIG. 5 illustrating the end tape product.

As best shown in FIG. 6 of the drawings, a portion of a first adhesive side 62 of the first tape strip is attached to a portion of a second adhesive side 72 of the second tape strip a width X. This width X may be varied by adjusting the position of the frames 20, 40, or by directly adjusting the positions of the spools 30, 32. The first side 64 of the first tape strip and the second side 74 of the second tape strip are preferably non-adhesive and are positioned opposite of one another as best illustrated in FIG. 6 of the drawings.

F. Operation of Invention

Figure 7:
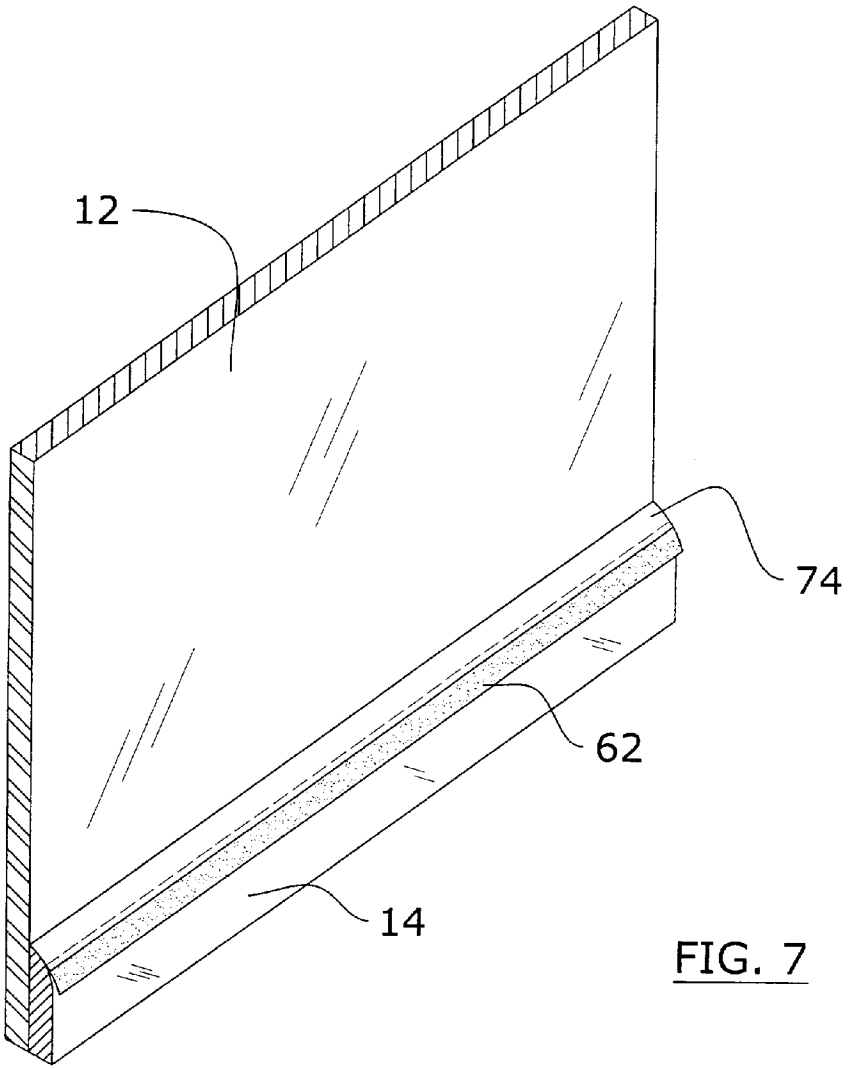
FIG. 7 is an upper perspective view of the end tape product secured to an edge of a baseboard adjacent a wall to be painted.
Figure 8:
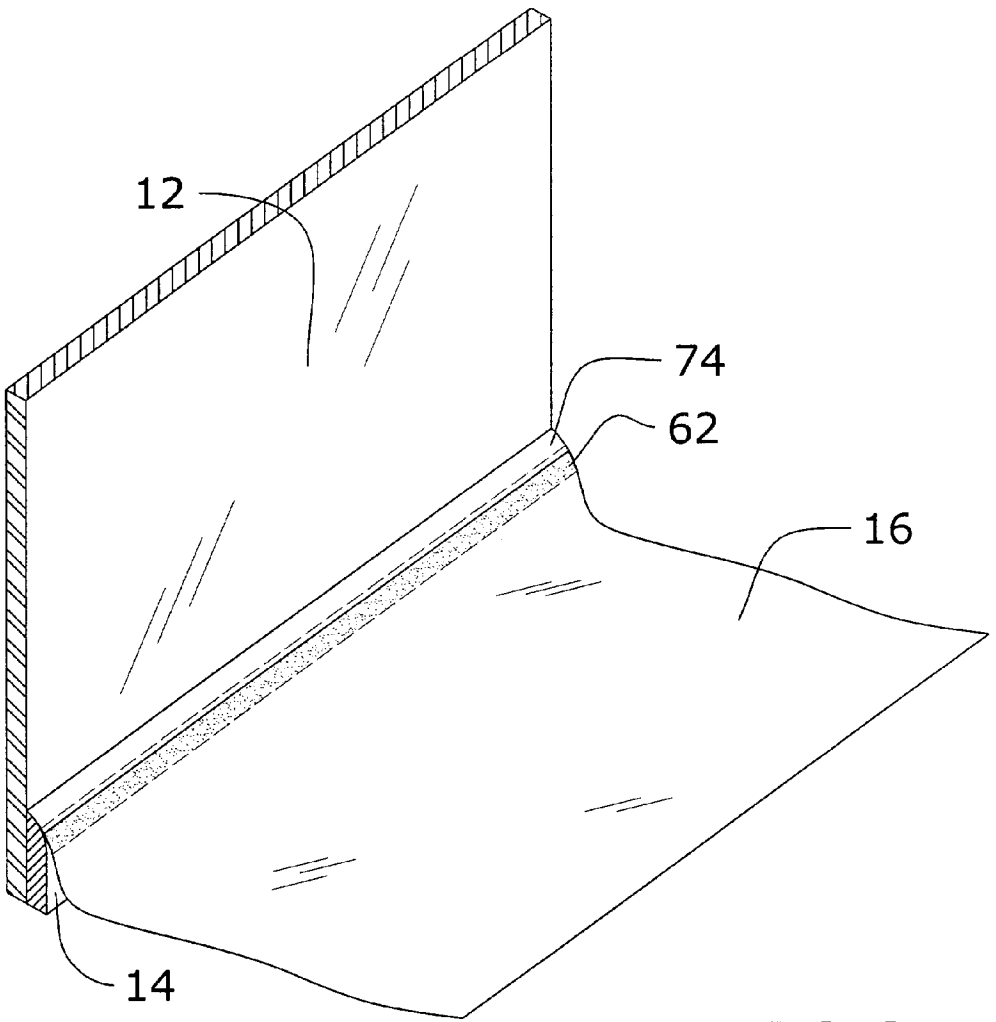
FIG. 8 is an upper perspective view illustrating the securing of a protective sheet to the baseboard utilizing the end tape product.

In use, the user draws the first tape strip from the first tape roll 60 and the second tape strip from the second tape roll 70 over the respective guide members 28, 48 as best illustrated in FIGS. 1 and 3 of the drawings. The first adhesive side 62 and the second adhesive side 72 of the tape strips are thereafter in opposition to one another and after passing about the guide members 28, 48 are secured together. The curved ends of the bases 22, 42 may also engage the tape strips thereby facilitating the attachment of the first adhesive side 62 to the second adhesive side 72. The first tape strip attached to the second tape strip in an overlapped manner as best illustrated in FIGS. 5 and 6 of the drawings, wherein the first tape strip is overlapped upon the second tape strip a width X. The desired length of the end tape product is then either torn or cut. The second adhesive side 72 (or the first adhesive side 62) is then attached to the perimeter of the item to be protected such as baseboard 14 adjacent to a wall 12 to be painted as shown in FIG. 7 of the drawings. The opposing first adhesive side 62 is then exposed for receiving a protective sheet 16 or other protective member thereby eliminating the step of having to apply a second length of tape to the sheet 16 as shown in FIG. 8 of the drawings. The present invention may be utilized for extended periods of time until the tape rolls 60, 70 require replacement which is achieved by simply removing the old tape rolls 60, 70 and installing the replacement tape rolls 60, 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tape dispensing system, comprising:

a frame structure;

a first spool and a second spool rotatably attached to the frame structure for supporting a first tape roll and a second tape roll;

a first guide member and a second guide member attached to the frame for guiding a first tape strip and a second tape strip to overlap one another a width X during dispensing forming an end tape product, wherein a portion of a first adhesive side of said first tape strip is attached to a portion of a second adhesive side of said second tape strip; and wherein said frame structure is comprised of a first frame and a second frame adjustably connected to one another for allowing adjustment of said width X.

2. The tape dispensing system of claim 1, wherein said first spool and said second spool have substantially parallel rotational planes.

3. The tape dispensing system of claim 2, wherein said rotational planes of said first spool and said second spool are a distance Y apart.

4. The tape dispensing system of claim 3, wherein said distance Y is approximately equal to said width X.

5. The tape dispensing system of claim 1, including one or more spacer members attachable between said first frame and said second frame thereby allowing adjustment of said width X.

6. The tape dispensing system of claim 1, wherein said width X is less than ½ a width of said first tape strip.

7. The tape dispensing system of claim 1, wherein said first tape roll and said second tape roll rotate opposite of one another.

8. The tape dispensing system of claim 1, wherein said frame structure includes a handle.

9. The tape dispensing system of claim 1, wherein said frame structure includes a base structure.

* * * * *